United States Patent [19]

Phalen, Jr.

[11] Patent Number: 4,506,483

[45] Date of Patent: Mar. 26, 1985

[54] ROOF CONSTRUCTION

[75] Inventor: Thomas E. Phalen, Jr., Winchester, Mass.

[73] Assignee: Roofblok Limited, Fitchburg, Mass.

[21] Appl. No.: 520,648

[22] Filed: Aug. 5, 1983

[51] Int. Cl.[3] ..... E04D 3/02

[52] U.S. Cl. ..... 52/408; 52/302; 52/303; 52/409

[58] Field of Search ..... 52/408, 409, 410, 602–611, 52/302, 303; 404/41, 36, 43, 34

[56] References Cited

U.S. PATENT DOCUMENTS

| | | | |
|---|---|---|---|
| 1,558,129 | 10/1925 | Warren | 404/41 X |
| 3,387,420 | 6/1968 | Long | 52/302 X |
| 3,892,899 | 7/1975 | Klein . | |

FOREIGN PATENT DOCUMENTS

| | | | |
|---|---|---|---|
| 712301 | 6/1965 | Canada | 52/302 |
| 2250555 | 4/1974 | Fed. Rep. of Germany | 52/302 |
| 378510 | 7/1964 | Switzerland | 52/302 |

*Primary Examiner*—Donald G. Kelly
*Assistant Examiner*—Richard E. Chilcot, Jr.

[57] ABSTRACT

A roof construction comprising ballast blocks each having two parallel edges bevelled at substantially identical angles of 12° to 23° from the vertical, the remaining two edges being substantially vertical, the blocks being laid in a pattern adjacent each rectangular corner of the roof so that downwardly and outwardly bevelled edges are adjacent each roof edge at the corner.

6 Claims, 9 Drawing Figures

ROOF CONSTRUCTION

This invention relates to a roof construction having a layer of ballast blocks disposed on top of a water-impermeable membrane and pertains more specifically to a pattern of alignment of blocks adjacent rectangular corners of the roof to achieve maximum resistance to disruption of the blocks by storm winds.

It has previously been proposed to provide roof constructions comprising a deck covered by a water-impermeable membrane, the membrane being held in place and protected by loose ballast blocks, each of which has a rectangular configuration as described for example in Kline U.S. Pat. No. 3,892,899, with or without additional layers of thermal insulation and/or wear resistant outer protective layers. However, when such blocks are light in weight, i.e. weigh less than about 20 lbs. per square foot of top face, they are subject to disruption and breakage by the forces generated by high winds such as normally occur in storms, the disruptive forces being particularly troublesome in areas adjacent the rectangular corners of roofs and when the wind direction is toward the corner at an angle of approximately 45° to each edge.

It has now been found that enhanced wind resistance can be achieved in a rectangular corner of a roof by laying abutting ballast block, each having two parallel edges bevelled at substantially identical angles of 12° to 23° from the vertical and the remaining two edges substantially vertical, in such a pattern in the corner that the outer rows of the blocks, except for the corner blocks, are arranged with outwardly and downwardly bevelled edges adjacent the edge of the deck, and providing means for clamping said block edges to the deck, each successive row of blocks inwardly from the outer row having the same alignment as the outer row except for the corner block at the intersection of rows, each corner block in each row being in alignment with either of the two rows of which it forms a corner, the pattern extending inwardly from each edge of the roof corner for at least ten rows.

Ballast blocks useful in practicing the present invention are described and claimed in copending U.S. patent application Burgoyne and Phalen Ser. No. 520,647, filed Aug. 5, 1983, the disclosure of which is incorporated herein by reference.

In the drawings,

FIG. 1 is an isometric view showing one embodiment of a ballast block useful in practicing the present invention;

FIG. 1*a* is a top plan view of the block of FIG. 1;

FIG. 2 is a view similar to that of FIG. 1 showing the bottom face of the block;

FIG. 2*a* is a bottom plan view of the block of FIG. 1;

Figure 1:
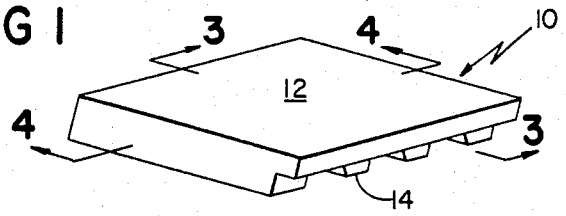
Figure 2:
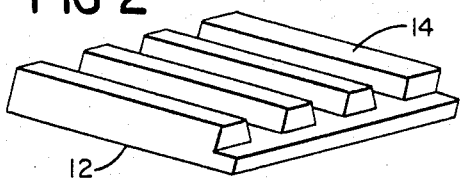
Figure 1A:
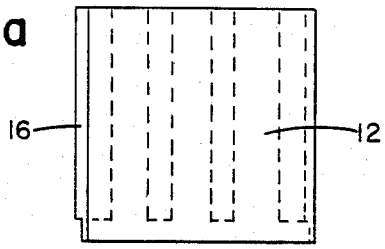
Figure 2A:
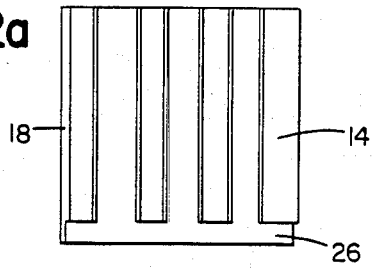
Figure 3:
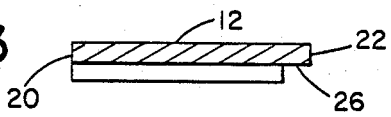
FIG. 3 is a view in section taken along line 3—3 of FIG. 1.
Figure 4:
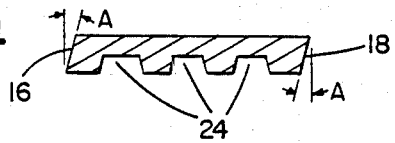
FIG. 4 is a view in section taken along line 4—4 of FIG. 1.

As appears from FIGS. 1–4 of the drawing a preferred ballast block for use in practicing the present invention comprises a block 10 having rectangular, e.g. square top and bottom faces 12, 14 and having two parallel edges 16, 18 bevelled at substantially identical angles from the vertical. The angles A shown in FIG. 4 can vary from 12° to 23°. The remaining two edges 20,22 are substantially vertical. In the bottom face 14 are preferably a plurality of parallel spaced channels 22,24 parallel to bevelled edges 16,18, and an additional optional channel 26 which is transverse to the parallel channels 24 and which extends adjacent and parallel to vertical edge 22. While the channels 24 are parallel to bevelled edges 16,18 in the preferred embodiment, they can in an alternative embodiment be arranged parallel to the vertical edges 20,22.

The block is composed of lightweight concrete containing expanded shale or similar aggregate made from clay, shale or slate having substantially the same physical properties, a minor proportion of sand, and Portland cement, as described in Phalen, Advances in Materials, Technology in the Americas, Vol. 1, pages 87–92 (New York 1980), the proportions being selected as described therein to provide a block having a density or specific gravity from 85 to 155 pounds per cubic foot (determined according to ASTM C 331), a compressive strength of at least 2500 psi (determined according to ASTM C 192 and C 495 using 15×30 cm. cylinders), a flexure tensile strength of at least 300 psi (determined according to ASTM C 293), and a capability of undergoing at least 100 freeze-thaw cycles without cracking (determined according to ASTM C666). The weight of a block having the configuration shown in FIGS. 1 to 4 which is 1 foot on a side and 2 inches thick is from 10 to 17 pounds per square foot of upper face.

The preferred block used in the present invention can be made in a conventional concrete block making machine by an extrusion procedure from a zero slump mixture of expanded shale or similar aggregate made from clay, shale or slate having substantially the same physical properties, Portland cement, sand and water in the desired proportions. Blocks made in this manner normally have channels 24 parallel to bevelled sides 16,18 and have the transverse channel 26, when present, adjacent to vertical edge 22, as shown in FIGS. 1–4 of the drawing.

Figure 5:
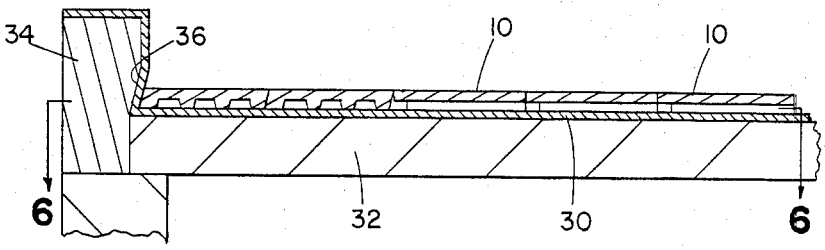
FIG. 5 is a view in cross-section showing a roof having a corner constructed in accordance with the present invention.
Figure 6:
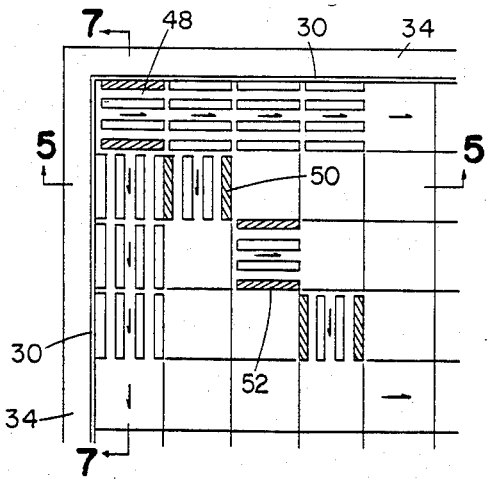
FIG. 6 is a view in section taken along line 6—6 of FIG. 5.
Figure 7:
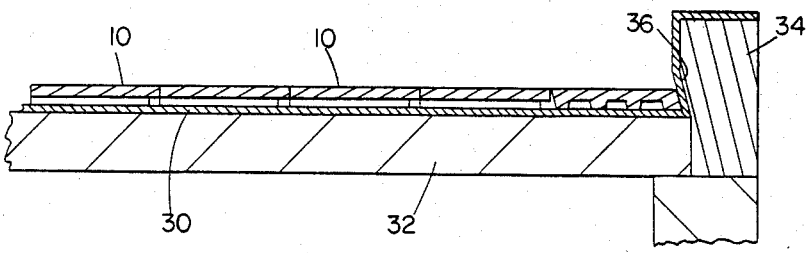
FIG. 7 is a view in section taken along line 7—7 of FIG. 6.

As shown in FIGS. 5–7, in the simplest roof construction the blocks 10 are merely laid in loosely-abutting relation directly on top of water-impermeable membrane 30 which in turn is supported by roof deck 32. Membrane 30 may be of any conventional composition such as butyl rubber, plastic, asphalt-impregnated felt, or the like. Parapet 34 extends along the edge of deck 32 and is provided with a sloping inner wall 36. The blocks are laid in such a pattern that all of each outer row of blocks 10,10 have their outwardly and downwardly bevelled edges arranged adjacent to the outer edge of deck 32 except for corner block 48 which is not in alignment with one of the two outer rows of which it forms a corner, but instead is turned 90° so as to be in alignment with the other outer row. Consequently, the sloping wall 36 of parapet 34, which overlies the bevelled edges 16 of the blocks serves to clamp this row of blocks to the deck. Similarly, each successive row of blocks inwardly from each outer row has the same alignment as the outer row with the exception that each corner block 50,52 of each successive row may be in alignment with either of the two rows of which it forms a corner. For maximum resistance to disruption it is essential that the specified pattern be maintained for at least ten rows inwardly from each edge of the deck at the corner, preferably for fifteen successive rows, and that it be maintained for at least fifteen successive blocks from the corner along the outer row. Further inwardly toward the center of the roof and away from the corner the alignment of the blocks in each row has no appreciable effect upon resistance to disruption by wind forces, so that the blocks may be laid indiscriminately, without regard to alignment. In order to provide for maximum drainage of water from the surface of the membrane, however, it is desirable to have channels 24,24 of each block arranged parallel to the direction of slope of the roof deck even in the central portion of the roof. If desired, there can be used in place of parapet 34 a tapered blocking strip having a sloping inner face which is anchored to the parapet or on the deck adjacent its edges and which serves to clamp the outer row of blocks to the deck in the same manner as the parapet.

It will be noted that in the case of blocks 10 laid in the patterns shown in FIGS. 5–7 of the drawing, the bevelled edges of the blocks facilitate sliding movement of the blocks over each other in the case of thermal expansion or contraction and also facilitate removal and/or replacement of individual blocks by the insertion of a lifting tool or pry member between the bevelled faces of adjacent blocks.

What is claimed is:

1. In a roof construction comprising a deck having at least one rectangular corner, a membrane, and a layer of abutting rows of ballast blocks laid above said membrane, each of said blocks having two parallel edges bevelled at substantially identical angles of 12° to 23° from the vertical, the remaining two edges being substantially vertical, the improvement which comprises having the blocks in said corner in a pattern in which the outer rows of said blocks except for the corner blocks are arranged with outwardly and downwardly bevelled edges adjacent to the edge of the deck, and means for clamping said block edges to said deck, each successive row of blocks inwardly from said outer row having the same alignment as said outer row except for the corner block at the intersection of the rows, each corner block in each row being in alignment with either of the two rows of which it forms a corner, said pattern extending inwardly from each edge of the roof corner for at least ten rows.

2. A roof construction as claimed in claim 1 in which an adhesive is present between said bevelled edges of adjacent blocks to bond said edges together.

3. A roof construction as claimed in claim 1 or 2 in which at least one additional layer of blocks in the same pattern is on top of said first layer.

4. A roof construction as claimed in claim 1 or 2 in which each said block has a plurality of parallel spaced channels in its bottom face parallel to said bevelled edges.

5. A roof construction as claimed in claim 1 or 2 in which each said block has a plurality of parallel spaced channels in its bottom face parallel to said bevelled edges and an additional channel in its bottom face adjacent and parallel to one said vertical edge.

6. A roof construction as claimed in claim 1 or 2 in which each said block has a weight of 10 to 17 lbs. per square foot of top face, a compressive strength of at least 2500 psi, a flexure strength of at least 300 psi, and is capable of undergoing at least 100 freeze thaw cycles without cracking.

* * * * *